US012460536B2

(12) United States Patent
Alsadah et al.

(10) Patent No.: US 12,460,536 B2
(45) Date of Patent: Nov. 4, 2025

(54) METHOD AND APPARATUS FOR ELECTRICAL SUBMERSIBLE PUMP (ESP) CONTROL AND REPLACEMENT

(71) Applicant: SAUDI ARABIAN OIL COMPANY, Dhahran (SA)

(72) Inventors: Hashim A. Alsadah, Safwa (SA); Mostafa Bori, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 459 days.

(21) Appl. No.: 18/148,026

(22) Filed: Dec. 29, 2022

(65) Prior Publication Data

US 2024/0218782 A1 Jul. 4, 2024

(51) Int. Cl.
*E21B 47/008* (2012.01)
*F04D 13/10* (2006.01)

(52) U.S. Cl.
CPC ..... *E21B 47/008* (2020.05); *F04D 13/10* (2013.01)

(58) Field of Classification Search
None
See application file for complete search history.

(56) References Cited

U.S. PATENT DOCUMENTS 7,979,240 B2 7/2011 Fielder
2005/0143956 A1* 6/2005 Long ..... F04D 15/0088 702/184
2007/0252717 A1* 11/2007 Fielder ..... F04D 13/10 417/63
2009/0211763 A1 8/2009 Fowler et al.
(Continued)

FOREIGN PATENT DOCUMENTS

EP 4026984 A1 7/2022
WO 2013090416 A2 6/2013
(Continued)

OTHER PUBLICATIONS

L. Peng et al.; "A Predictive Model to Detect the Impending Electric Submersible Pump Trips and Failures", SPE-206150-MS; Society of Petroleum Engineers; Sep. 2021; pp. 1-10 (10 pages).
(Continued)

*Primary Examiner* — Lina Cordero
(74) *Attorney, Agent, or Firm* — Osha Bergman Watanabe & Burton LLP

(57) ABSTRACT

A method includes obtaining operating data regarding a plurality of Electrical Submersible Pump (ESP) systems in a field of interest. The operating data describe respective replacements of each of the ESP systems, respective compatibility type of each of the ESP systems, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time. The method includes determining a failure rate of a first compatibility type of ESP system using the operating data, determining whether the failure rate satisfies a predetermined criterion; and transmitting a command to alter an ESP. The method includes replacing one or more ESP systems with a replacement based on a selection of each ESP systems to be replaced on the display.

20 Claims, 5 Drawing Sheets

(56) References Cited

U.S. PATENT DOCUMENTS

| | | | |
|---|---|---|---|
| 2018/0216447 | A1 | 8/2018 | Al-Zahrani |
| 2019/0317488 | A1 | 10/2019 | Al-Maghlouth et al. |
| 2020/0325766 | A1 | 10/2020 | Gupta et al. |
| 2020/0386091 | A1 * | 12/2020 | Eslinger ..... F04D 15/0066 |
| 2022/0004179 | A1 | 1/2022 | Badkoubeh |

FOREIGN PATENT DOCUMENTS

| | | | |
|---|---|---|---|
| WO | 2014039512 | A1 | 3/2014 |
| WO | WO-2017083141 | A1 * | 5/2017 |
| WO | 2017161126 | A1 | 9/2017 |

OTHER PUBLICATIONS

A. Celemin et al.; "Model Comparison for Esp Run-Life Prediction: Classic Statistics Vs. Machine Learning", SPE-206028-MS; Society of Petroleum Engineers; Sep. 2021; pp. 1-12 (12 pages).

P. Bhattacharjee et al.; "Quantitive risk assessment of submersible pump components using Interval number-based Multinomial Logistic Regression(MLR) model", Reliability Engineering and System Safety; vol. 226; Jun. 30, 2022; pp. 1-14 (14 pages).

R. Abdalla et al.; "Machine Learning Approach for Predictive Maintenance of the Electrical Submersible Pumps (ESPs)", ACS Omega; vol. 7; 2022; pp. 17641-17651 (11 pages).

A. S. Bhardwaj et al.; "Real-Time Monitoring and Predictive Failure Identification for Electrical Submersible Pumps", SPE-197911-MS: Society of Petroleum Engineers; Nov. 2019; pp. 1-11 (11 pages).

D. Guo et al.; "Data Driven Approach to Failure Prediction for Electrical Submersible Pump Systems", SPE-174062-MS; Society of Petroleum Engineers; Apr. 2015; pp. 1-6 (6 pages).

L. Peng et al.; "Predictive Approach to Perform Fault Detection in Electrical Submersible Pump Systems", ACS Omega; vol. 6; 2021; pp. 8104-8111 (8 pages).

M N. Noui-Mehidi and M. Arsalan; "Dynamical Study of Quasi-Steady Conditions for Startup Operations of Electrical Submersible Pumps", SPE-185271-MS; Society of Petroleum Engineers; Apr. 2017; pp. 1-7 (7 pages).

J. Zhu and H. Zhang; "A Review of Experiments and Modeling of Gas-Liquid Flow in Electrical Submersible Pumps", Energies; vol. 11; No. 180; Jan. 11, 2018; pp. 1-41 (41 pages).

* cited by examiner

METHOD AND APPARATUS FOR ELECTRICAL SUBMERSIBLE PUMP (ESP) CONTROL AND REPLACEMENT

BACKGROUND

In hydrocarbon well development, it is common practice to use electrical submersible pump (ESP) systems as a primary form of artificial lift. It is common in the industry for the life of an ESP system to be unpredictable. ESP system failures may be caused by operational conditions, equipment type, and downhole environment. Preparation for replacement of ESP systems is crucial because replacing an ESP system can cause an increase in operation costs, production losses, and damage in equipment.

Accordingly, there exists a need for a method to plan for upcoming ESP replacement and execute the ESP system replacements.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method comprising: obtaining, by a remote server, operating data regarding a plurality of Electrical Submersible Pump (ESP) systems in a field of interest, wherein the operating data describe respective replacements of each of the plurality of ESP systems within the field of interest, respective compatibility type of each of the plurality of ESP systems within the field of interest, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time, determining, by the remote server, a failure rate of a first compatibility type of ESP system using the operating data, determining, by the remote server, whether the failure rate of the first compatibility type of ESP system satisfies a predetermined criterion; and transmitting, by the remote server and in response to determining that the failure rate of the first compatibility type fails to satisfy the predetermined criterion, a command to alter an ESP in a first ESP system among the plurality of ESP systems having the first compatibility type; determining, by the remote server, a location of each of the plurality of ESP systems having the first compatibility type, determining, by the remote server, the failure rate of each of the ESP systems having the first compatibility type using the operating data, displaying, by the remote server, a number of failures of each ESP system having the first compatibility type, a number of replacement ESP systems of the first compatibility type available, the failure rate for each of the ESP systems having the first compatibility type, and the location of each of the plurality of ESP systems having the first compatibility type; and replacing one or more ESP systems having the first compatibility type with a replacement ESP system of the first compatibility type based on a selection of each ESP systems to be replaced on the display.

In one aspect, embodiments disclosed herein relate to a server, comprising: a processor; and a memory coupled to the processor, wherein the memory comprises functionality for: obtaining, by a remote server, operating data regarding a plurality of Electrical Submersible Pump (ESP) systems in a field of interest, wherein the operating data describe respective replacements of each of the plurality of ESP systems within the field of interest, respective compatibility type of each of the plurality of ESP systems within the field of interest, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time, determining, by the remote server, a failure rate of a first compatibility type of ESP system using the operating data, determining, by the remote server, whether the failure rate of the first compatibility type of ESP system satisfies a predetermined criterion; and transmitting, by the remote server and in response to determining that the failure rate of the first compatibility type fails to satisfy the predetermined criterion, a command to alter an ESP in a first ESP system among the plurality of ESP systems having the first compatibility type; determining, by the remote server, a location of each of the plurality of ESP systems having the first compatibility type, determining, by the remote server, the failure rate of each of the ESP systems having the first compatibility type using the operating data, displaying, by the remote server, a number of failures of each ESP system having the first compatibility type, a number of replacement ESP systems of the first compatibility type available, the failure rate for each of the ESP systems having the first compatibility type, and the location of each of the plurality of ESP systems having the first compatibility type; and replacing one or more ESP systems having the first compatibility type with a replacement ESP system of the first compatibility type based on a selection of each ESP systems to be replaced on the display.

In one aspect, embodiments disclosed herein relate to a non-transitory computer-readable medium comprising computer-executable instructions stored thereon that, when executed on a processor, cause the processor to perform: obtaining, by a remote server, operating data regarding a plurality of Electrical Submersible Pump (ESP) systems in a field of interest, wherein the operating data describe respective replacements of each of the plurality of ESP systems within the field of interest, respective compatibility type of each of the plurality of ESP systems within the field of interest, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time, determining, by the remote server, a failure rate of a first compatibility type of ESP system using the operating data, determining, by the remote server, whether the failure rate of the first compatibility type of ESP system satisfies a predetermined criterion; and transmitting, by the remote server and in response to determining that the failure rate of the first compatibility type fails to satisfy the predetermined criterion, a command to alter an ESP in a first ESP system among the plurality of ESP systems having the first compatibility type; determining, by the remote server, a location of each of the plurality of ESP systems having the first compatibility type, determining, by the remote server, the failure rate of each of the ESP systems having the first compatibility type using the operating data, displaying, by the remote server, a number of failures of each ESP system having the first compatibility type, a number of replacement ESP systems of the first compatibility type available, the failure rate for each of the ESP systems having the first compatibility type, and the location of each of the plurality of ESP systems having the first compatibility type; and replacing one or more ESP systems having the first compatibility type with a replacement ESP system of the first compatibility type based on a selection of each ESP systems to be replaced on the display.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a method for altering or replacing an Electrical Submersible Pump (ESP) system.

Figure 1:
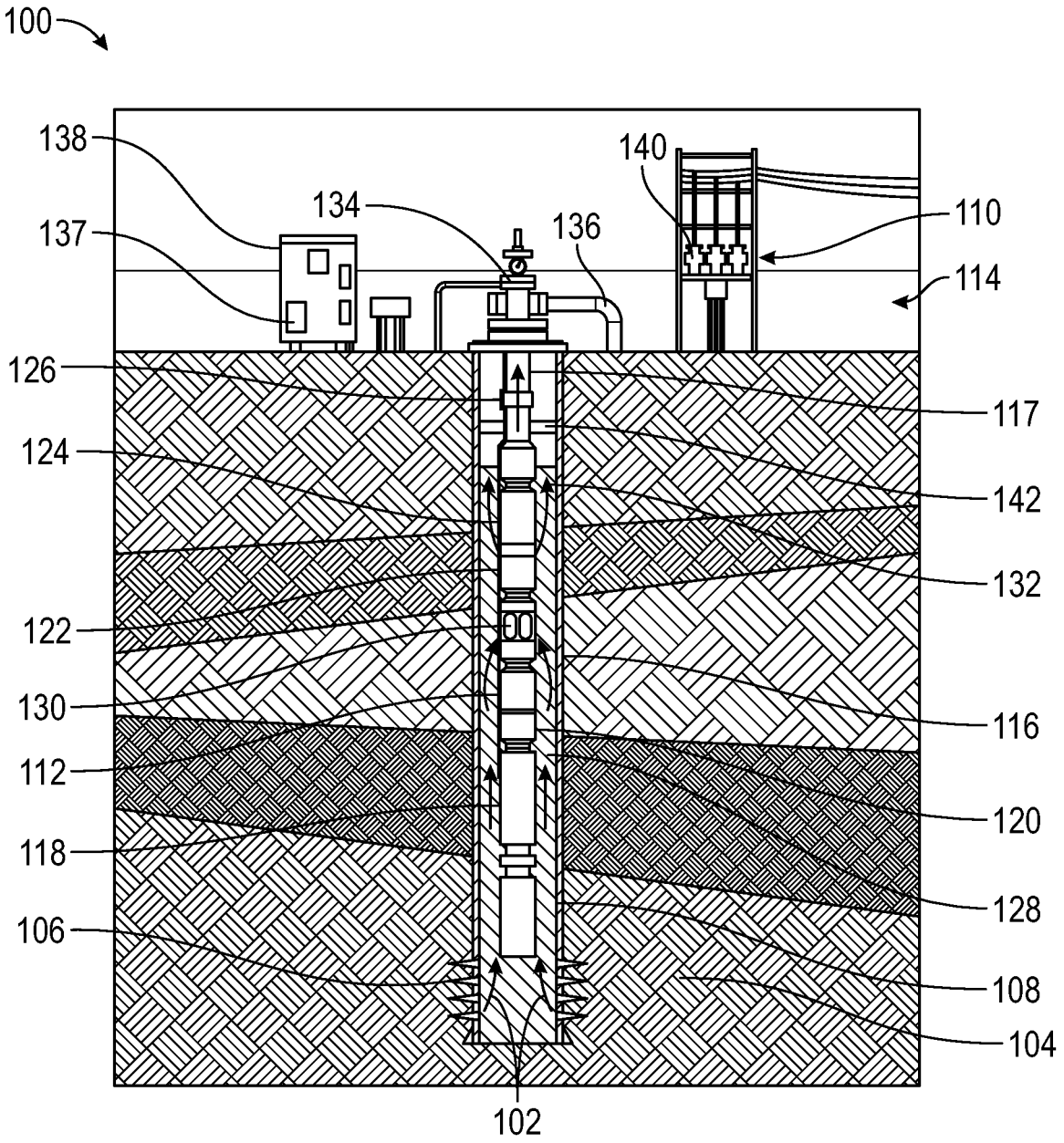
FIG. 1 shows an exemplary well with an Electrical Submersible Pump (ESP) completion design in accordance with one or more embodiments.

FIG. 1 shows an exemplary Electrical Submersible Pump (ESP) system (100). The ESP system (100) is one example of an artificial lift system that is used to help produce fluids (102) from a formation (104). The well (116) may be open hole or include perforations (106). Perforations (106) in the well's (116) casing string (108) provide a conduit for the reservoir fluids (102) to enter the well (116) from the formation (104). An ESP system (100) is an example of the artificial lift system, ESP system and artificial lift system may be used interchangeably within this disclosure. The ESP system (100) includes surface equipment (110) and an ESP string (112). The ESP string (112) is deployed in a well (116) on production tubing (117) and the surface equipment (110) is located on the surface (114). The production tubing (117) extends to the surface (114) and is made of a plurality of tubulars connected together to provide a conduit for reservoir fluids (102) to migrate to the surface (114). The surface (114) is any location outside of the well (116), such as the Earth's surface.

The ESP string (112) may include a motor (118), motor protectors (120), a gas separator (122), a multi-stage centrifugal pump (124) (herein called an "ESP" (124)), and a power cable (126). The ESP string (112) may also include various pipe segments of different lengths to connect the components of the ESP string (112). The motor (118) is a downhole submersible motor (118) that provides power to the ESP (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the ESP (124) requires to lift an estimated volume of reservoir fluids (102) from the bottom of the well (116) to the surface (114). The motor (118) is cooled by the reservoir fluids (102) passing over the motor housing. The motor (118) is powered by the power cable (126). The power cable (126) may also provide power to downhole pressure sensors or onboard electronics that may be used for communication. The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116). The power cable (126) may be in the annulus between the production tubing (117) and casing string (108), from now on referred to as "the annulus (128)". The annulus (128) is the space in the well (116) between the casing string (108) and the ESP string (112). In further embodiments, the ESP string (112) may have a hydraulic line that is a conduit for hydraulic fluid. The hydraulic line may act as a sensor to measure downhole parameters such as discharge pressure from the outlet of the ESP (124).

Motor protectors (120) are located above (i.e., closer to the surface (114)) the motor (118) in the ESP string (112). The motor protectors (120) are a seal section that houses a thrust bearing. The thrust bearing accommodates axial thrust from the ESP (124) such that the motor (118) is protected from axial thrust. The seals isolate the motor (118) from reservoir fluids (102). The seals further equalize the pressure in the annulus (128) with the pressure in the motor (118). The pump intake (130) is the section of the ESP string (112) where the reservoir fluids (102) enter the ESP string (112) from the annulus (128).

The pump intake (130) is located above the motor protectors (120) and below the ESP (124). The depth of the pump intake (130) is designed based off of the formation (104) pressure, estimated height of reservoir fluids (102) in the annulus (128), and optimization of ESP (124) performance. If the reservoir fluids (102) have associated gas, then a gas separator (122) may be installed in the ESP string (112) above the pump intake (130) but below the ESP (124). The gas separator (122) removes the gas from the reservoir fluids (102) and directs the gas (depicted as separated gas (132) in FIG. 1) into the annulus (128). If the volume of gas exceeds a designated limit, a gas handling device may be installed below the gas separator (122) and above the pump intake (130). The gas handling device may be installed as a standalone gas handler without a gas separator.

The ESP (124) is located above the gas separator (122) and lifts the reservoir fluids (102) to the surface (114). The ESP (124) has a plurality of stages that are stacked upon one another. Each stage contains a rotating impeller and stationary diffuser. As the reservoir fluids (102) enter each stage, the reservoir fluids (102) pass through the rotating impeller to be centrifuged radially outward gaining energy in the form of velocity. The reservoir fluids (102) enter the diffuser, and the velocity is converted into pressure. As the reservoir fluids (102) pass through each stage, the pressure continually increases until the reservoir fluids (102) obtain the designated discharge pressure and has sufficient energy to flow to the surface (114).

A packer (142) is disposed around the ESP string (112). Specifically, the packer (142) may be located above (i.e., closer to the surface (114)) the multi-stage centrifugal pump (124) or downhole from the multi-stage centrifugal pump (124). The packer (142) may be any packer (142) known in the art such as a mechanical packer (142). The packer (142) seals the annulus (128) space located between the ESP string (112) and the casing string (108). This prevents the reservoir fluids (102) from migrating past the packer (142) in the annulus (128). The ESP system (100) may include more than one packer (142) dependent on completion requirements.

In other embodiments, sensors may be installed in various locations along the ESP string (112) to gather downhole data such as pump intake pressures, discharge pressures, shaft speeds and vibrations, and temperatures. The number of stages is determined prior to installation based on the estimated required discharge pressure. Over time, the formation (104) pressure may decrease and the height of the reservoir fluids (102) in the annulus (128) may decrease. In these cases, the ESP string (112) may be removed and resized. Once the reservoir fluids (102) reach the surface (114), the reservoir fluids (102) flow through the wellhead (134) into production equipment (136). The production equipment (136) may be any equipment that can gather or transport the reservoir fluids (102) such as a pipeline or a tank.

The remainder of the ESP system (100) includes various surface equipment (110) such as electric drives (137), production controller (138), the control module, and an electric power supply (140). The electric power supply (140) provides energy to the motor (118) through the power cable (126). The electric power supply (140) may be a commercial power distribution system or a portable power source such as a generator. The production controller (138) is made up of an assortment of intelligent unit-programmable controllers and drives which maintain the proper flow of electricity to the motor (118) such as fixed-frequency switchboards, soft-start controllers, and variable speed controllers. The production controller (138) may be a variable speed drive (VSD), well choke, inflow control valve, and/or sliding sleeves. The production controller (138) is configured to perform automatic well operation adjustments. The production controller (138) may perform adjustments to alter an ESP (124). The electric drives (137) may be variable speed drives which read the downhole data, recorded by the sensors, and may scale back or ramp up the motor (118) speed to optimize the ESP (124) efficiency and production rate. The electric drives (137) allow the ESP (124) to operate continuously and intermittently or be shut-off in the event of an operational problem.

Figure 2:
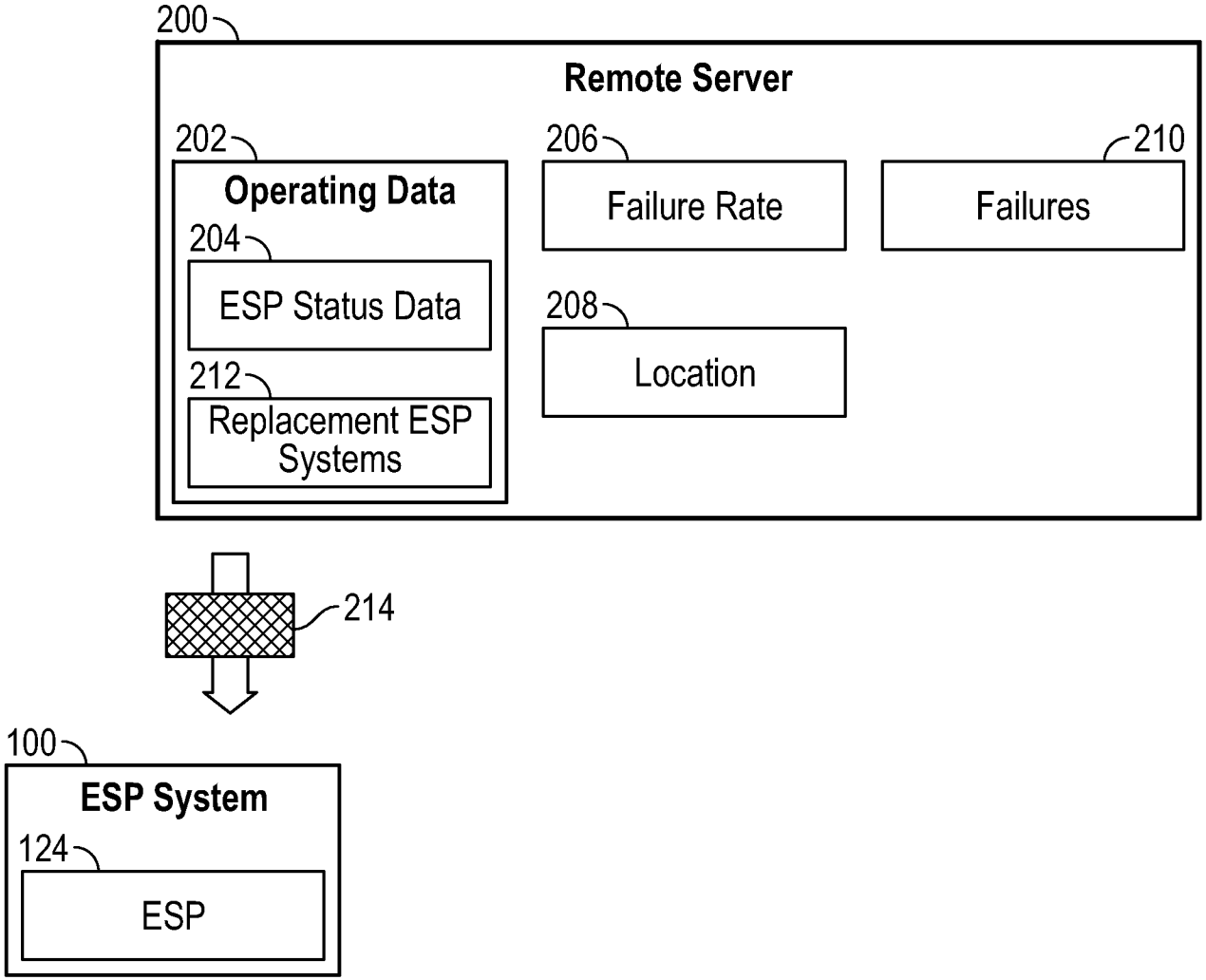
FIG. 2 shows a system in accordance with one or more embodiments.

FIG. 2 shows a system in accordance with one or more embodiments. As shown in FIG. 2, a remote server (200) may communicate over a network (not shown) with an ESP system (100). The remote server (200) may include hardware and/or software disposed in a cloud computing environment at a remote location from the production controller (138) in the ESP system (100). The remote server (200) may include operating data (202), ESP status data (204), failure rate (206), location (208), failures (210), and replacement ESP systems (212) data.

The remote server (200) may obtain operating data (202). The operating data (202) may regard a plurality of ESP systems (100) in a field of interest. The field of interest may be any area with one or more ESP systems (100). The operating data (202) may describe respective replacements of each of the ESP systems (100) within the field of interest, respective compatibility type of each of the ESP systems (100), and ESP status data (204). The operating data may be measured by a sensor disposed on the ESP system (100). The respective replacements of each of the ESP systems (100) may be replacement ESP systems (212). Replacement ESP systems (212) designed ESP systems (100) for replacement purposes. The respective compatibility type of each of the ESP systems (100) may describe any compatible ESP systems (100) with their respective equipment in the field of interest.

The remote server (200) may determine a failure rate (206) of an ESP system (100) using the operating data (202). The remote server (200) may display one or more failures (210) of ESP systems (100). The remote server (200) may display the location (208) of the ESP system (100) of which desires replacement. The remote server (200) is configured to transmit a command (214) to the ESP system (100). The command (214) may be a command to alter the ESP (124) in an ESP system (100).

Figure 3:
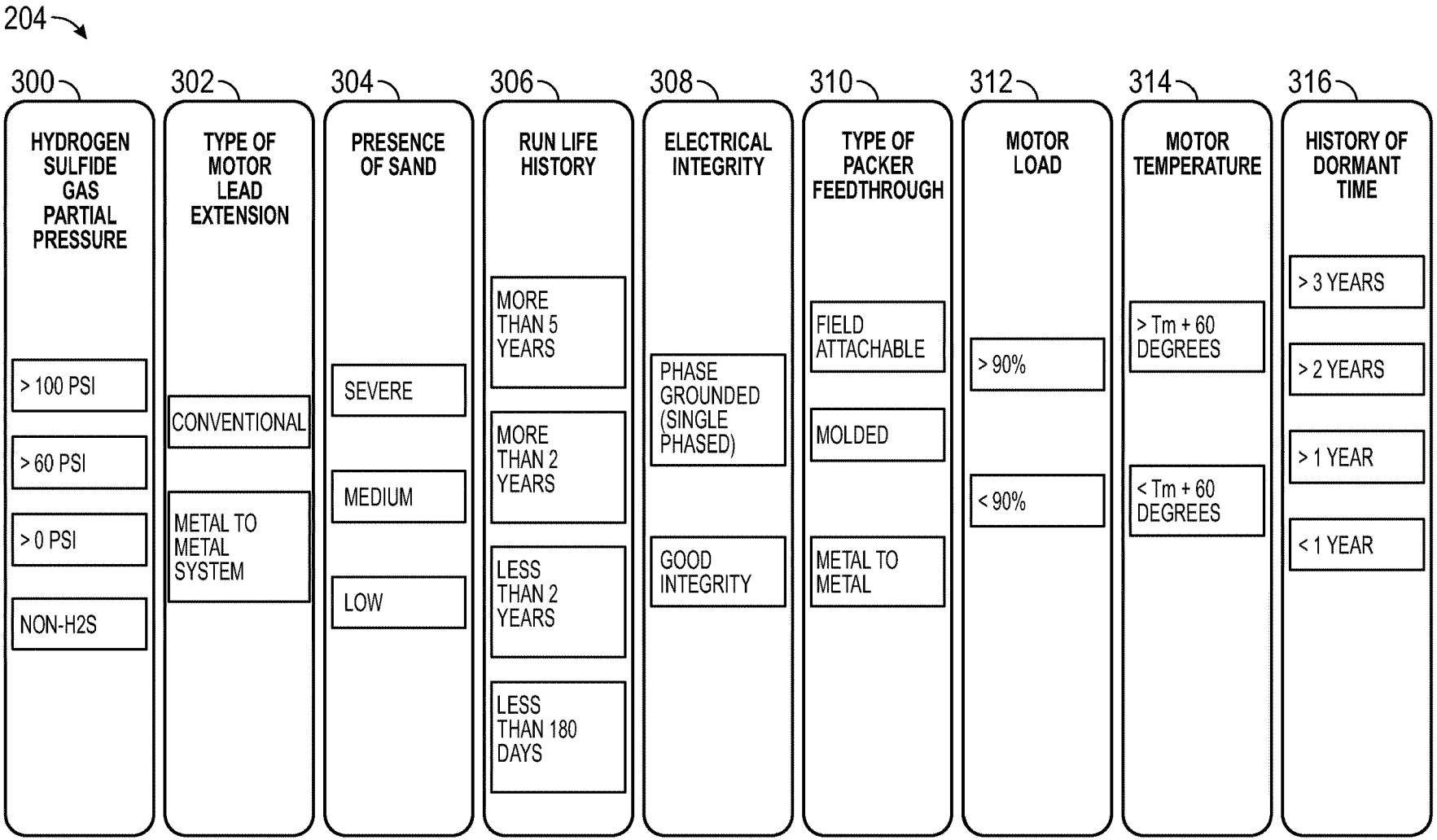
FIG. 3 shows an example in accordance with one or more embodiments.

FIG. 3 shows an example of ESP status data (204) described in the operating data (202). ESP system (100) failure is known in the industry as the point when an ESP system (100) becomes uneconomical. ESP system (100) failure may mean the ESP system (100) seized operation or any component in the ESP system (100) failed. The ESP system (100) may be pulled from the well (116) when a failure occurs. The ESP status data (204) identifies factors that contribute to ESP system (100) failure. The ESP status data (204) includes hydrogen sulfide gas partial pressure (300), type of Motor Lead Extension (MLE) (302), presence of sand (304), run life history (306), electrical integrity (308), type of packer feedthrough (310), motor load (312), motor temperature (314), and history of dormant time (316). The ESP status data (204) may be weighted from least critical to most critical based in part on specifications of the ESP status data (204).

Hydrogen Sulfide gas (H2S) partial pressure (300) is the pressure exerted by H2S in reservoir fluid (102). Hydrogen sulfide gas partial pressure (300) in the ESP system (100) environment may be calculated from downhole pressure sensors and fluid properties. Fluid properties may be identified from oil samples tested on surface (114). H2S mole fraction may be measured from the fluid properties. H2S gas partial pressure (300) may be calculated through multiplying the downhole pressure with the H2S mole fraction. H2S gas partial pressure (300) may be measured in pounds per square inch (psi). The H2S gas partial pressure (300) may be specified as non-H2S, greater than 0 psi, greater than 60 psi, or greater than 100 psi. The ESP system (100) may include an MLE. The MLE may be a power cable (126) extending from a pothead on the motor (118) to the packer (142). The type of MLE (302) is the seal system of the MLE (302). The seal system may be conventional or metal to metal system. Conventional seal systems may be systems involving dependent sealing on rubber material and O rings to prevent gas and fluid contamination with the MLE (302).

The environment of the ESP system (100) may have a presence of sand (304). The formation (104) may contain sand material that may potentially plug the ESP system (100). The presence of sand (304) may be known from compatible ESP systems (100) in the field of interest, from the type of drilled formation, or from previous ESP system (100) pulls in the same well (116). The presence of sand (304) may be the severity of sand in each of the ESP systems (100) in the field of interest. The presence of sand (304) may be specified as low, medium, or severe based at least in part on severity of sand. Run life history (306) may be the amount of time an ESP system (100) has operated before being pulled. Run life history (306) may be the time from the commissioning date of the ESP system (100) to the date the ESP system (100) is still running. Run life history (306) may be taken from compatible ESP systems (100) in the field of interest. Run life history (306) may be specified as less than 180 days, less than 2 years, more than 2 years, or more than 5 years.

Electrical integrity (308) may be based on the condition of the integrity of the power cable (126) in the ESP system (100). Electrical integrity (308) may be specified as phase grounded or good integrity. Good integrity may mean that the power cable (126) is working properly with all phases intact. It is common in the industry for a power cable (126) to be three-phase. Phase grounded may mean that the power cable (126) is single phased. Phase grounded may mean that the sensors in the ESP system (100) can no longer communicate to surface (114), however, the ESP system (100) may still operate. The power cable (126) passes through the packer (142) to the surface (114). A feedthrough system may be installed for the power cable (126) and packer (142) connection. The packer feedthrough system may maintain the seal of the packer (142). Type of Packer feedthrough (310) may be specified as field attachable, molded, or metal to metal. The field attachable packer feedthrough is assembled at the rig dependent on rubber material for sealing. The rig may be a production platform on surface (114). The molded packer feedthrough is assembled at the manufacturer before sending the molded packer feedthrough to the rig. The metal to metal packer feedthrough is assembled at the rig. The sealing of the metal to metal packer feedthrough are metal to metal seals.

The motor load (312) may be the load on a motor (118). The motor load (312) may be calculated as a percentage. The motor load (312) may be calculated by dividing the current motor amperage by the motor nameplate amperage, then multiplying by 100. The current motor amperage may be measured by a sensor. The motor load (312) may be specified as less than 90% or greater than 90%.

The motor temperature (314) may be the temperature of the motor (118). The motor temperature (314) may be measured by a sensor. The motor temperature (314) may be specified as greater than the initial motor temperature (Tm) in addition to 60 degrees Fahrenheit (F) or less than the initial motor temperature (Tm) in addition to 60 degrees Fahrenheit (F). The initial motor temperature is the temperature the motor (118) is when installed in the ESP system (100). The history of dormant time (316) may be the amount of time the ESP system (100) has been installed but not commissioned. The history of dormant time (316) may be specified as less than 1 year, greater than 1 year, greater than 2 years, or greater than 3 years.

The ESP status data (204) may be assigned weights for each specified factor from less critical to more critical to indicate the possibility of failure. The assigned weights may be normalized to achieve a factor, for example, from 0 to 4. Each ESP (124) in a field of interest may have an operational score of 0 to 1 for low, 1 to 2 for medium, 2 to 3 for high, or 3 to 4 for critical. The operational score may be the failure rate of the ESP system (100). In one or more embodiments, all the following achieve an operational score of 4: greater than 100 psi of H2S partial pressure (300), conventional type of MLE (302), greater than 5 years of run life history (306), phase grounded electrical integrity (308), field attachable packer feedthrough (310), greater than 90% motor load (312), greater than Tm in addition to 60 degrees motor temperature (314), and greater than 3 years of dormant time (316). For example, if an ESP system (100) achieved all the above operational scores of 4, the ESP system (100) may indicate high severity of failure.

Figure 4:
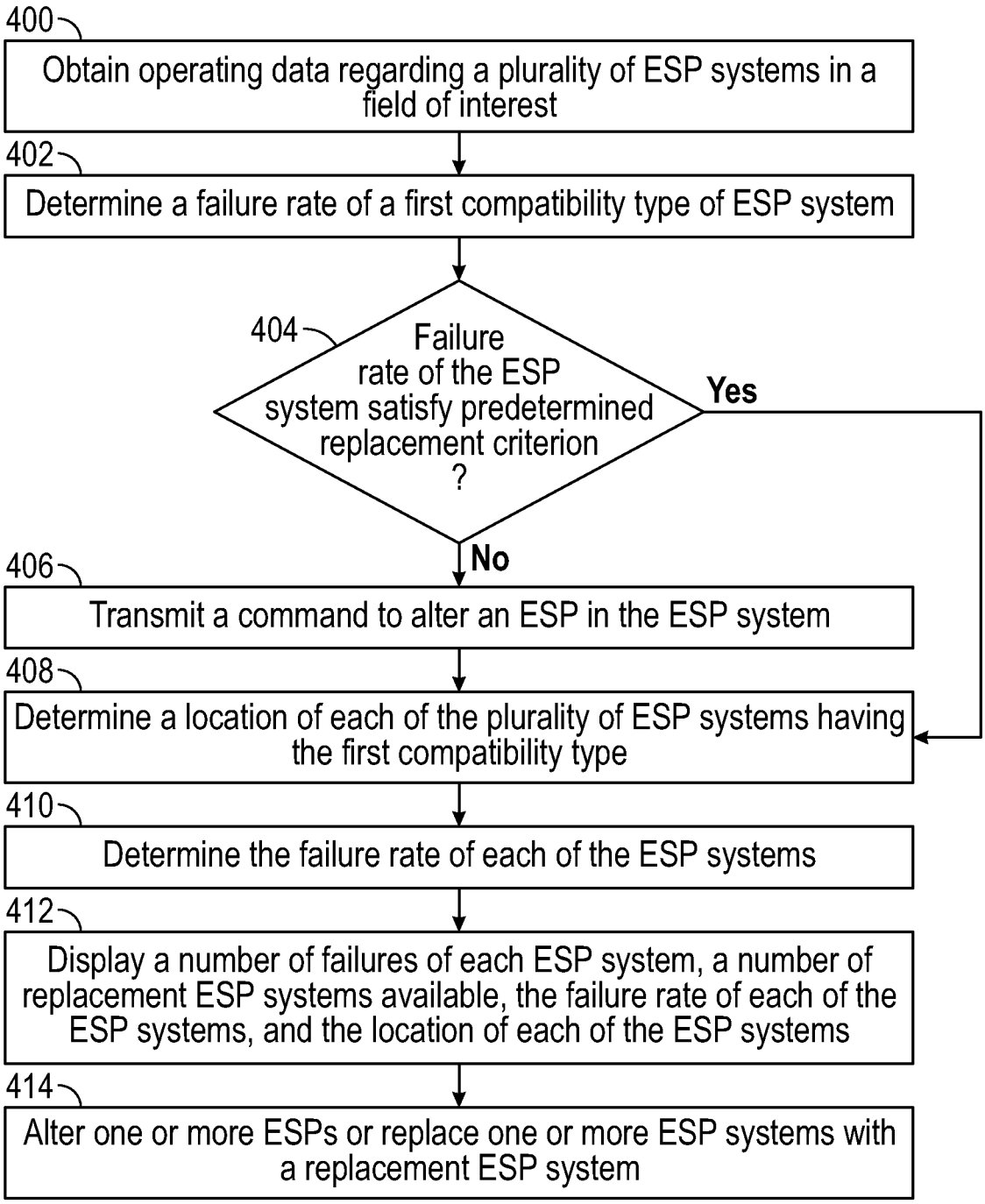
FIG. 4 shows a flow chart in accordance with one or more embodiments.

FIG. 4 shows a flowchart in accordance with one or more embodiments. Specifically, FIG. 4 describes a specific method for performing failure rate (206), alterations, and replacements of one or more ESP systems (100) in a field of interest. One or more blocks in FIG. 4 may be performed by one or more components described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, operating data (202) regarding a plurality of ESP systems (100) in a field of interest is obtained. The operating data (202) may be obtained by a remote server (200). The operating data (202) may describe respective replacements of each of the plurality of ESP systems (100) within the field of interest, respective compatibility type of each of the plurality of ESP systems (100), and ESP status data (204). The ESP status data (204) may include H2S gas partial pressure (300), type of MLE (302), presence of sand (304), run life history (306), electrical integrity (308), type of packer feedthrough (310), motor load (312), motor temperature (314), and history of dormant time (316).

In Block 402, a failure rate (206) of a first compatibility type of ESP system (100) is determined. The failure rate (206) is determined by the remote server (200) using the operating data (202). In Block 404, a determination is made whether a failure rate (206) of an ESP system (100) satisfies a predetermined replacement criterion, e.g., whether the failure rate (206) exceeds a failure rate threshold. Examples of replacement criterion may include the factor described in FIG. 3. The predetermined replacement criterion may correspond to a plurality of predetermined values of the operating data (202) of ESP system (100) failures over a predetermined amount of time. Where a determination is made that the failure rate (206) of an ESP system (100) fails to satisfy a predetermined replacement criterion, the process shown in FIG. 4 may proceed to Block 406. Where a determination is made that the failure rate (206) of an ESP system (100) satisfies a predetermined replacement criterion, the process shown in FIG. 4 may proceed to Block 408

In Block 406, a command (214) to alter an ESP (124) in the ESP system (100) is transmitted. The command (214) may be transmitted by the remote server (200) and in response to determining the failure rate (206) of the first compatibility type in Block 404. The command (214) may alter an ESP (124) in a first ESP system (100) among the plurality of ESP systems having the first compatibility type.

In Block 408, a location of each of the plurality of ESP systems (100) having the first compatibility type is determined. The location (208) may be determined by the remote server (200). In Block 410, a failure rate (206) of each of the ESP systems (100) having the first compatibility type is determined. The failure rate (206) may be determined by the remote server (200) using the operating data (202). In Block 412, a number of failures of each ESP system (100), a number of replacement ESP systems (212) available, the failure rate (206) of each of the ESP systems (100), and the location (208) of each of the ESP systems (100) is displayed by the remote server (200).

In Block 414, one or more ESPs (124) are altered, or one or more ESP systems (100) are replaced with a replacement ESP system (212). One or more ESP systems (100) having the first compatibility type are replaced with a replacement ESP system (212) of the first compatibility type based on a selection of each ESP systems (100) to be replaced on the display. One or more ESPs (124) may be altered through an operation via the command (214). The operation may be a frequency of the ESP (124). One or more ESPs (124) may be shut down based at least in part of at least one of the ESP status data (204) violating a predetermined threshold value. The predetermined threshold value may be a value set by a user. The ESP (124) may be shut down via the command (214).

Figure 5:
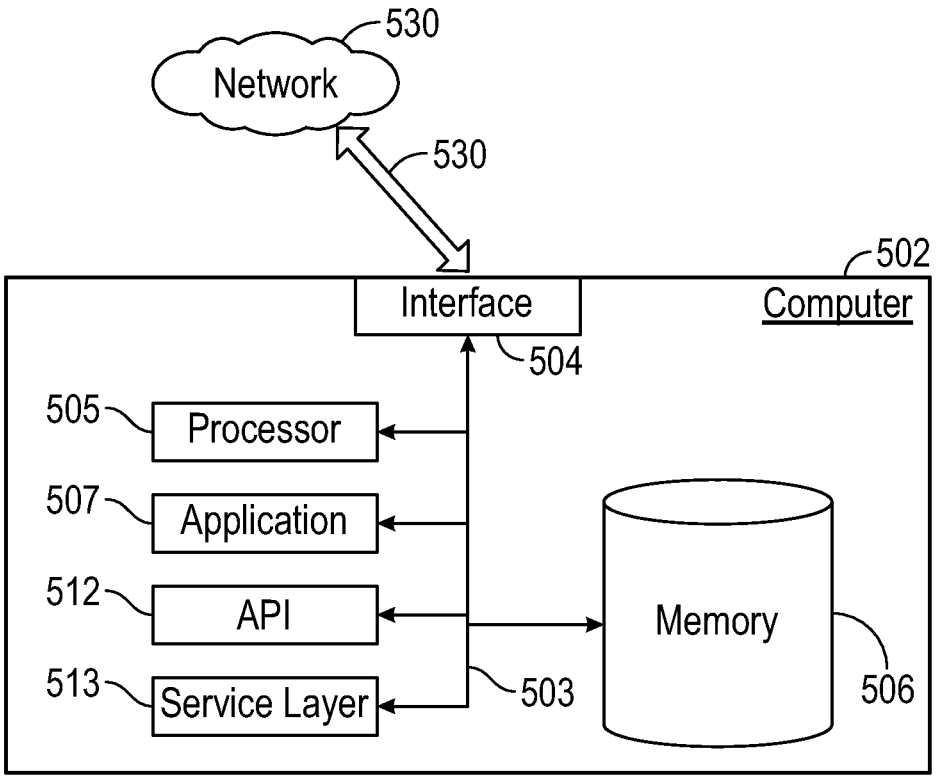
FIG. 5 shows a computer system in accordance with one or more embodiments.

FIG. 5 shows a computer (502) system in accordance with one or more embodiments. Specifically, FIG. 5 shows a block diagram of a computer (502) system used to provide computational functionalities associated with described algorithms, methods, functions, processes, flows, and procedures as described in the instant disclosure, according to an implementation. The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any, or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513)). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502).

The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a non-transitory computer (502) readable medium, or a memory (506), that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method comprising:

obtaining, by a remote server, operating data regarding a plurality of Electrical Submersible Pump (ESP) systems in a field of interest, wherein the operating data describe respective replacements of each of the plurality of ESP systems within the field of interest, respective compatibility type of each of the plurality of ESP systems within the field of interest, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time, determining, by the remote server, a failure rate of a first compatibility type of ESP system using the operating data, determining, by the remote server, whether the failure rate of the first compatibility type of ESP system satisfies a predetermined criterion; and transmitting, by the remote server and in response to determining that the failure rate of the first compatibility type fails to satisfy the predetermined criterion, a command to alter an ESP in a first ESP system among the plurality of ESP systems having the first compatibility type;

determining, by the remote server, a location of each of the plurality of ESP systems having the first compatibility type, determining, by the remote server, the failure rate of each of the plurality of ESP systems having the first compatibility type using the operating data, displaying, by the remote server, a number of failures of each ESP system having the first compatibility type, a number of replacement ESP systems of the first compatibility type available, the failure rate for each of the plurality of ESP systems having the first compatibility type, and the location of each of the plurality of ESP systems having the first compatibility type; and replacing one or more ESP systems having the first compatibility type with a replacement ESP system of the first compatibility type based on a selection of each ESP system to be replaced on a display.

2. The method of claim 1 further comprising:

altering an operation of the ESP, via the command, wherein the operation is a frequency of the ESP.

3. The method of claim 1 further comprising:

shutting down the ESP, via the command, based at least in part on at least one of the ESP status data violating a predetermined threshold value.

4. The method of claim 1, wherein the type of MLE is a type of power cable on each of the plurality of ESP systems and wherein the type of MLE is a conventional power cable or a metal-to-metal power cable.

5. The method of claim 1, wherein the presence of sand is based at least in part on a severity of sand in each of the plurality of ESP systems.

6. The method of claim 1, wherein the electrical integrity is a condition of a power cable in each of the plurality of ESP systems and wherein the electrical integrity is phase grounded or good integrity.

7. The method of claim 1, wherein the type of packer feedthrough is a field attachable packer feedthrough, a molded packer feedthrough, or a metal-to-metal packer feedthrough.

8. The method of claim 1, wherein the motor load is a load on a motor in each of the plurality of ESP systems.

9. The method of claim 1, wherein the motor temperature is a temperature of a motor in each of the plurality of ESP systems.

10. The method of claim 1 further comprising:

measuring the operating data by a sensor disposed on each of the plurality of ESP systems.

11. The method of claim 1, wherein the predetermined criterion corresponds to a plurality of predetermined values of the operating data of ESP system failures over a predetermined amount of time.

12. The method of claim 1, wherein the predetermined criterion is modified by adjusting an operational score within a predetermined fit threshold.

13. A server comprising:

a processor; and a memory coupled to the processor, wherein the memory comprises functionality for:

obtaining operating data regarding a plurality of Electrical Submersible Pump (ESP) systems in a field of interest, wherein the operating data describe respective replacements of each of the plurality of ESP systems within the field of interest, respective compatibility type of each of the plurality of ESP systems within the field of interest, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time, determining a failure rate of a first compatibility type of ESP system using the operating data, determining whether the failure rate of the first compatibility type of ESP system satisfies a predetermined criterion; and transmitting, in response to determining that the failure rate of the first compatibility type fails to satisfy the predetermined criterion, a command to alter an ESP in a first ESP system among the plurality of ESP systems having the first compatibility type;

determining a location of each of the plurality of ESP systems having the first compatibility type, determining the failure rate of each of the plurality of ESP systems having the first compatibility type using the operating data, displaying a number of failures of each ESP system having the first compatibility type, a number of replacement ESP systems of the first compatibility type available, the failure rate for each of the plurality of ESP systems having the first compatibility type, and the location of each of the plurality of ESP systems having the first compatibility type; and replacing one or more ESP systems having the first compatibility type with a replacement ESP system of the first compatibility type based on a selection of each ESP system to be replaced on a display.

14. The server of claim 13, wherein the memory further comprises functionality for:

altering an operation of the ESP, via the command, wherein the operation is a frequency of the ESP.

15. The server of claim 13, wherein the memory further comprises functionality for:

shutting down the ESP, via the command, based at least in part on at least one of the ESP status data violating a predetermined threshold value.

16. The server of claim 13, wherein the predetermined criterion corresponds to a plurality of predetermined values of the operating data of ESP system failures over a predetermined amount of time.

17. A non-transitory computer-readable medium comprising computer-executable instructions stored thereon that, when executed on a processor, cause the processor to perform:

obtaining, by a remote server, operating data regarding a plurality of Electrical Submersible Pump (ESP) systems in a field of interest, wherein the operating data describe respective replacements of each of the plurality of ESP systems within the field of interest, respective compatibility type of each of the plurality of ESP systems within the field of interest, and ESP status data comprising: a hydrogen sulfide gas partial pressure, a type of Motor Lead Extension (MLE), a presence of sand, a run life history, an electrical integrity, a type of packer feedthrough, a motor load, a motor temperature, and a history of dormant time, determining, by the remote server, a failure rate of a first compatibility type of ESP system using the operating data, determining, by the remote server, whether the failure rate of the first compatibility type of ESP system satisfies a predetermined criterion; and transmitting, by the remote server and in response to determining that the failure rate of the first compatibility type fails to satisfy the predetermined criterion, a command to alter an ESP in a first ESP system among the plurality of ESP systems having the first compatibility type;

determining, by the remote server, a location of each of the plurality of ESP systems having the first compatibility type, determining, by the remote server, the failure rate of each of the plurality of ESP systems having the first compatibility type using the operating data, displaying, by the remote server, a number of failures of each ESP system having the first compatibility type, a number of replacement ESP systems of the first compatibility type available, the failure rate for each of the plurality of ESP systems having the first compatibility type, and the location of each of the plurality of ESP systems having the first compatibility type; and replacing one or more ESP systems having the first compatibility type with a replacement ESP system of the first compatibility type based on a selection of each ESP system to be replaced on a display.

18. The non-transitory computer readable medium of claim 17 further comprising:

altering an operation of the ESP, via the command, wherein the operation is a frequency of the ESP.

19. The non-transitory computer readable medium of claim 17 further comprising:

shutting down the ESP, via the command, based at least in part on at least one of the ESP status data violating a predetermined threshold value.

20. The non-transitory computer readable medium of claim 17, wherein the predetermined criterion corresponds to a plurality of predetermined values of the operating data of ESP system failures over a predetermined amount of time.

* * * * *